US007430883B2

(12) United States Patent
Sørensen

(10) Patent No.: US 7,430,883 B2
(45) Date of Patent: Oct. 7, 2008

(54) GARMENT, PREFERABLY FOR NURSING, AND METHOD FOR PROVIDING SUCH

(75) Inventor: Bettina Balslev Sørensen, Silkeborg (DK)

(73) Assignee: Tytex A/S, Ikast (DK)

( * ) Notice: Subject to any disclaimer, the term of this patent is extended or adjusted under 35 U.S.C. 154(b) by 20 days.

(21) Appl. No.: 11/403,557

(22) Filed: Apr. 13, 2006

(65) Prior Publication Data

US 2006/0277948 A1 Dec. 14, 2006

(30) Foreign Application Priority Data

Apr. 15, 2005 (DK) ..... 2005 00550

(51) Int. Cl.
*A41D 1/20* (2006.01)

(52) U.S. Cl. ..... 66/176; 66/171; 450/36

(58) Field of Classification Search ..... 66/169 R, 66/170, 171, 175, 176; 450/36, 8
See application file for complete search history.

(56) References Cited

U.S. PATENT DOCUMENTS 5,269,720 A * 12/1993 Moretz et al. ..... 450/37
6,287,168 B1 * 9/2001 Rabinowicz ..... 66/171
6,645,041 B2 * 11/2003 Sørensen ..... 450/36
6,854,132 B1 * 2/2005 Polzin ..... 2/104
6,855,029 B2 * 2/2005 Rothman ..... 450/36
7,076,809 B2 * 7/2006 Rothman ..... 2/104
2003/0097860 A1 5/2003 Sciacca
2003/0186617 A1 * 10/2003 Sorensen ..... 450/37
2005/0028243 A1 * 2/2005 Polzin ..... 2/104

FOREIGN PATENT DOCUMENTS

WO WO 01/68964 9/2001
WO WO 03/082033 10/2003

* cited by examiner

*Primary Examiner*—Danny Worrell
(74) *Attorney, Agent, or Firm*—James Creighton Wray; Clifford D. Hyra

(57) ABSTRACT

The present invention relates to a method for providing a nursing garment from a circular knitted fabric tube, where the nursing garment comprises a back portion and a front portion comprising breast cups completely or partly formed from at least a double layer of fabric, forming inner and outer breast cups, wherein said double layer of fabric is knitted integrally in one piece and used in an open or closed loop form, allowing knitting to be continued downwards from below the breasts.

Figure 1:
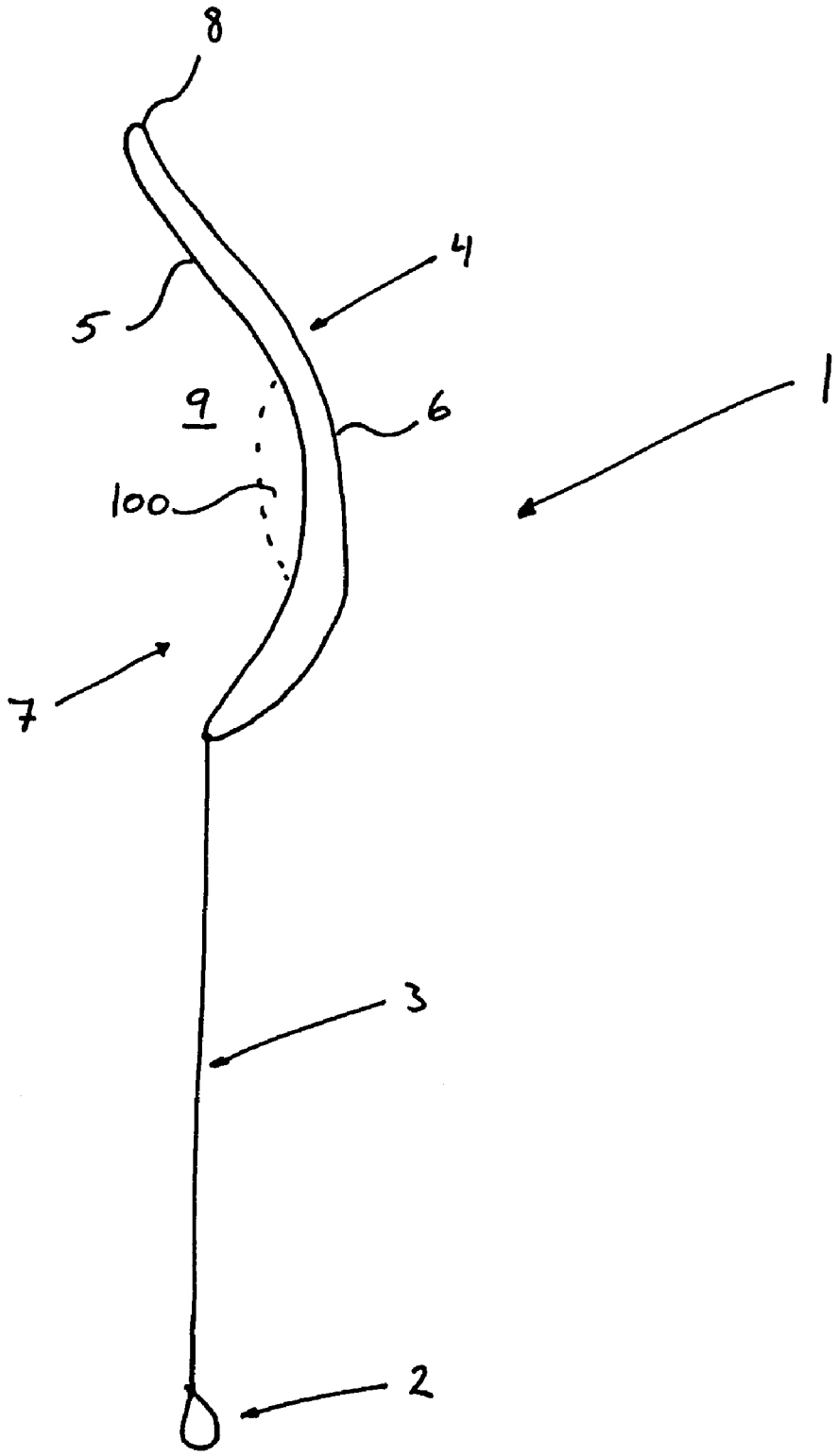

The present invention furthermore relates to a garment, preferably for use when nursing, produced by the aforementioned method.

17 Claims, 14 Drawing Sheets

GARMENT, PREFERABLY FOR NURSING, AND METHOD FOR PROVIDING SUCH

This application claims the benefit of Danish Application No. PA 2005 00550 filed Apr. 15, 2005.

FIELD OF THE INVENTION

The present invention relates to a method for providing a nursing garment from a circular knitted fabric tube, where the nursing garment comprises a back portion and a front portion comprising breast cups completely or partly formed from at least a double layer of fabric, forming inner and outer breast cups.

Furthermore, the present invention relates to a garment, preferably for use when nursing and produced according to the aforementioned method.

BACKGROUND OF THE INVENTION

Nursing (in the form of breast feeding) can be unpleasant for some women, as they are not comfortable exposing their breasts, and quite often conventional nursing garment breast cups do not provide the breasts with the same support as a traditional brassiere.

However, nursing while wearing a traditional brassiere requires removal or release of the brassiere which is difficult while at the same time holding a child, and while nursing the child, the other breast is not comfortably supported.

Several companies provide nursing brassieres designed to expose one breast at the time, hence still supporting both breasts when nursing. These nursing brassieres are often provided with clasps above the cups, which are easily operated with one hand, hence making it possible to hold the child when releasing/fastening the outer cup.

Furthermore, some of these nursing brassieres are seamless or substantially seamless, which is a great advantage, as the seams of brassieres sewn from numerous different pieces of fabric may irritate the often tense and sore breasts of nursing women.

U.S. Pat. No. 6,287,168 discloses a substantially seamless brassiere made from a circular knitted fabric tube, which brassiere can be made of a single layer or of a double layered fabric.

The length of the shoulder straps may be adjustable allowing the woman to pull the brassiere cup over or under the breast, to pull the shoulder strap off the shoulder or to loosen the brassiere to expose a breast. However, the brassiere cannot open in front, and the outer cup can not be released and pulled down, thus it is not suitable nor intended for nursing purposes.

U.S. Pat. No. 6,645,041 discloses a substantially seamless nursing brassiere, which is made from a circular knitted fabric tube. The nursing brassiere is provided with a front portion with two cups, wherein a center portion is arranged between the two cups, a back portion, two side portions connecting the front and the back portion, a band fitting snugly around the chest is positioned under the breasts and a pair of shoulder straps extending from the back portion and which shoulder straps are connected to each of the front portion cups, and the cups are completely or partly formed of a double layered fabric.

Both types of seamless brassieres are made from a circular knitted fabric tube. As explained in U.S. Pat. No. 6,645,041 the substantially seamless brassiere described in U.S. Pat. No. 6,287,168 is not suitable for use as a nursing brassiere.

The seamless nursing brassieres described in U.S. Pat. No. 6,645,041 are made from a circular knitted fabric tube, where a knitted loop is used for providing a stretchable two-ply band (a closed loop), which is arranged for fitting snugly around and beneath the chest, and the breast cup areas are formed from two body-encircling tube portions, forming respectively an inner cup and a releasable outer cup.

The drawback of all the mentioned nursing brassieres is that while nursing, the woman has to either lift up her clothes up (e.g. a T-shirt), pull them down (e.g. a stretchy camisole) or open them (e.g. a shirt), in order to release the outer cup while breast-feeding a baby.

This in turn exposes either the woman's belly or most of her upper body while nursing, which many women are not comfortable with, as it makes them feel indecent or cold.

Garments such as dresses or body stockings, which can not be opened in the breast area or be removed from the top, but have to be pulled up over the breast area for nursing, can hardly be worn, as the woman would basically end up exposing most of her lower body while nursing.

Thus, it would be advantageous to make a seamless nursing garment with the drop cup feature as a fuller garment, e.g. a vest, a tank top, a camisole, a chemise, a body stocking or a dress, that could be used alone or under clothes, which in turn would not expose the woman's belly when nursing, but cover her body, apart from the exposed nipple.

Such a garment is not described in either U.S. Pat. No. 6,645,041 or U.S. Pat. No. 6,287,168, nor is it possible to make use of the technique described in said patent, as no additional tube sections or tube ends are available to produce a body-encircling portion extending from the brassiere chest band and downwards seamlessly, as both tube sections or ends are bent upwards to form the inner and outer cup.

In U.S. Pat. No. 6,855,029 a nursing garment in the form of a camisole is described consisting of a minimum three-layer breast cup construction sewn from a series of cut out fabric parts, that are sewn together leaving the nursing mother with numerous seams sewn in elastic bands around her chest etc, which can be uncomfortable. No reference is made to seamless garments or seamless technology in U.S. Pat. No. 6,855,029.

OBJECT OF THE INVENTION

It is the object of the present invention to provide an improved method for making a garment, preferably for nursing, from a circular knitted fabric tube, hence making it possible to provide different garment types e.g. chemise, camisole, tank top, vest, shirt, dress, body stocking, brassiere or the like, all of which comprise cups completely or partly formed of a double layered fabric loop knitted in one piece, thus making them very suitable for child nursing purposes, while still covering the woman's body.

This object is achieved with a method described in the preamble of claim 1, wherein said double layer of fabric is knitted integrally in one piece and used in an open or closed loop form.

DESCRIPTION OF THE INVENTION

In the following a circular knitted tube is understood to be a substantially tube-shaped fabric, produced on a circular knitting machine for body size knitting, such as e.g. a Santoni machine.

State-of-the-art technology of body size knitting allows such tubes to be designed directly on the knitting machine, e.g. the tube design may have several different properties and sub-shapes, e.g. by combining materials, yarn types, knit with different tightness, different knitting structures, needle selection, knit-in text and logo's as well as pouches, breast cups and knitted double velts or "loops", as e.g. described in U.S. Pat. No. 6,645,041, for the formation of the chest band in a brassiere or the waistband of panties.

In the following a loop is understood to be an open or closed bending or a loop formation on a circular knitted fabric tube, e.g. made by hanging courses up in a waiting position and picking them up again after several rows of knitting (forming a closed loop), or simply by folding a tube in or outwards to itself when processing it after knitting (forming an open loop).

In the following clasps or closure means are understood to be release/fastening means, allowing the outer breast cup to be released in order to expose the inner breast cup, e.g. for nursing. The release/fastening means can be clasps, hook/eye, hook/loop, studs, zippers or other easily releasable means, that can preferably be operated by one hand.

In the following the back portion of the garment is understood as being either a part of the circular knitted tube or a part of a band provided from a closed loop forming the brassiere chest band.

The garment described in the present application preferably applies to the situation, where a woman nurses and breast-feeds a child; however the invention also applies in other situations, such as:

- during the nursing period where a nursing pad can be fastened between the nursing garment inner and outer cup,
- during pregnancy where breast support is needed, but traditional brassieres are uncomfortable for women as their breasts increase in size and at times become very sore and tense,
- after breast surgery, where a garment with a double layered cup can be used for fitting a breast prosthesis,
- a wound care garment with a double layered cup can be used to position and fixate bandages or dressings between the two layers, and the outer cup release mechanism can be used to access and change a bandage or check the wound condition in an easy and comfortable way, without having to remove the garment.

To produce a nursing garment which is comfortable to wear, the improved method according to the present invention comprises the step, where at least one loop is utilized to form e.g. a two-ply fabric loop in the breast area of a garment, the garment thereby substantially being formed from one single piece of tubular knitted fabric.

As explained above, the loop is knitted to or bend from a first portion of a circular knitted fabric, and the loop is subsequently used to form a partly or completely double fabric layer in the breast cup area of the nursing garment, thereby forming an inner cup and an outer cup layer from one single piece of tubular knitted fabric. Forming the two ply fabric this way, leaves an option open for extending the knitting of the tube downwards from below the breasts, which in turn makes it possible to cover up the nursing woman's belly while nursing, which is explained in more detail in the following.

In case the loop is knitted by hanging a row of courses up in a waiting position and picking them up after several rows of knitting, it is not obvious to a person skilled in the art that the loop can be used for anything else that knitting a two-fold band, e.g. a waistband, chest band or shoulder straps.

Manufacturers of knitting machines, which knitting machines are capable of knitting closed loops on the machine as described above, describe and utilize this machine feature for producing simpler loops that can be used for e.g. waist bands, edges of garments, stripy or folding effects on garments and the like. They do not mention the possibility of integrating advanced shapes such as i.e. breast cups, while the loop is being knitted.

However, by knitting an extensive number of rows with the row of courses in a waiting position according to this invention, and at the same time knitting in cup shapes for the inner and outer cups, a large loop containing both the inner and the outer cups can be knitted, leaving up to two tube ends available for extending the knitting downwards from below the breasts.

During or after knitting, the fabric loop forming the inner and outer breast cups may be opened at one or more appropriate spots by knitting a hole or using opening means, such as water soluble yarn, which dissolves when the circular knitted fabric tube is washed, or cutting means e.g. a scissor or knife.

Furthermore, the edges of the inner and outer breast cups as well as the back portion of the garment can be cut and sewn to the intended shape and size, and trims may be added.

The inner and outer breast cup knitting structure may be looser than the structure of the surrounding fabric, which makes the cups more elastic and able to surround, support and maintain the breasts in the desired position. The breast cups may also be moulded in a cup shape.

To make different types of garments one or more body encircling portions may be knitted to the circular knitted fabric extending downwards from the breast area. Hence it is possible to use such portions to form a chemise, a camisole, a tank top, a shirt, a dress, a stomach support, a body stocking or the like.

Furthermore, said body-encircling portion can be made of a supportive and/or elastic material, thus providing e.g. support for the stomach of a pregnant woman.

According to one embodiment of the present invention one or more additional conventionally closed loops for providing body-encircling bands may further be knitted to the circular knitted fabric tube. Such further bands can be applied as tight-fitting or loose bands encircling the body below the breast, the chest, the torso, the waist, the hip, the thighs or legs, or may form integrally knitted shoulder straps.

To keep the garment up and in the desired position during nursing and during wear, a pair of shoulder straps is connected to the front portion inner breast cups. The shoulder straps and/or the inner cups are then in turn connected in a releasable manner to the outer breast cups.

The shoulder straps can be an integral part of the circular knitted fabric tube or be a separate part, which is sewn on to the front and back portion of the garment. They may also be connected to the inner cups only, and instead of being connected to the garment back portion, they may be directly connected to each other or be connected by means of adhesive means behind the neck of the woman.

The shoulder straps in such a garment can be made adjustable in length e.g. by providing them with adjustable means, e.g. hook/eye or strap shorteners, making it possible to fit the nursing garment securely to different women's height, size and breast size, hence comfortably supporting the breasts.

The garment for nursing can be provided with closing means, such as a clasp arrangement connecting the outer cups to the shoulder strap and/or inner cup, which makes it possible for women to release the garment's outer cup and to pull the outer cup down to expose one or both breasts, without loosing the breast support, while only exposing part of her breast enabling the breast feeding to take place.

As the shoulder strap is connected to the garment's inner cup, releasing the outer breast cup does not cause the shoulder strap to slip to the back of the garment, and thus the support of the breasts is maintained while nursing.

Typically, the closing means may be clasps made of a polymeric material or metal alloys, which can be coloured, coated, dyed and/or varnished to match the garment. Other closing means, such as a hook/loop, hook/eye, snaps or the like may also be used.

Having released the garment outer breast cup, the woman can place the baby at the exposed breast for nursing, without exposing her belly. If she wants to change to the other breast, she may hold the baby with one hand while securing the garment outer breast cup with the other hand and subsequently release the other outer breast cup and place the baby at the other breast.

The knitted fabric tube, from which the garment is made, can be knitted from either end; in other words, the first knitted portion can be extending below the cups or the last knitted portion can be extending below the cups, or both knitted portions may be extending below the cups.

Hence the first knitted portion or the last knitted portion or both can provide the lower body-encircling part of a chemise, camisole, tank top, vest, shirt, dress or the bottom part of e.g. a body stocking.

Several alternative inner cup shapes and types and the advantages of theses different embodiments are described in details in U.S. Pat. No. 6,645,041.

The different parts of the garment can be produced in various designs by changing the knitting structure and/or by knitting with different yarns so that a certain design, shape or logo appears. The different parts of the garment may also differ as regards elasticity, thickness or strength; hence the nursing garment is well-fitting and comfortable to wear. E.g. the knitting structure of the back portion of the circular knitted tube may differ from the rest of the fabric so as to provide support to the woman's back.

Since the garment is made from a circular knitted fabric tube according to the method of the present invention, the woman usually needs to pull the garment over her head or pull it up from her feet when putting it on.

However, completely or partially vertical opening means may be incorporated, such as e.g. hook/loop, zipper, button/eye or hook/eye closures allowing the garment to be opened, put on and closed.

The back of the garment, in the following referred to as the garment back portion, may have multiple shapes and structures, independent of the breast cup construction. When a double layer is formed in the breast area of a nursing garment according to the present invention, a double layer will usually be formed at the back as well, due to the tubular knitted form.

However, it is possible to release the inner layer from the back portion at its base by e.g. knitting a hole, knitting in water soluble yarn or by cutting and/or sewing, and then use the inner layer to form e.g. the shoulder straps, an additional inner layer at the front of the garment or simply by cutting the inner layer off at the garment back portion leaving only the inner layer at the garment front portion.

Typically, a nursing garment according to the present invention is knitted of yarn made of one or more of the following fibre types; elastane, polyamide, polyester, cotton, wool, viscose and/or silk. The elastane provides elasticity to the knitted fabric.

The above mentioned yarn can be of micro fibre quality or of regular fibre thicknesses. A garment partly or completely knitted in micro fibres will be naturally softer, which makes the garment more comfortable to wear.

SHORT DESCRIPTION OF THE DRAWINGS

In the following the invention is explained in more detail with reference to the drawings, in which:

FIG. 1-14 shows a cross section of different embodiments of a garment according to the invention,

DETAILED DESCRIPTION

FIG. 1 shows a cross section of the front portion of the garment in the cup area consisting of a circular knitted fabric tube 1, where a first loop 2 is knitted to provide a bottom band, which fits snugly or loosely around the hip or the waist of a woman. The first loop 2 is connected to the bottom part of a first portion 3, and the top part of the first portion 3 is connected to both ends of a second loop 4, which provides both the inner layer 5 and the outer layer 6 of the cups 7. The second loop 4 is after knitting cut open near the top end 8 and is provided with clasps (not shown) to make it possible to release the outer layer 6 of the cups 7, hence exposing a breast 9, which is being supported by the inner layer 5 of the cups 7, which has an opening 100 for exposure of the nipple.

The circular knitted fabric tube 1 with the first loop 2 and the second loop 4 is made as follows:

- to knit the first loop 2 on the circular knitted fabric tube 1 a first row of courses is withheld in a waiting position ("hang up") at the knitting machine,
- the length of the first loop 2 is knitted,
- the first loop 2 is connected to the first portion 3 by collecting the waiting row of courses ("hung up courses"), and the knitting of the first portion 3 is continued,
- at the end of the first portion 3, the second loop 4 is started by hanging up a second row of courses in a waiting position, while knitting the full length of the second loop 4, and
- finally the second row of courses are collected to close the loop 4.

From this point on it is possible to continue the knitting downwards (not shown).

Near the top end 8 of the loop 4, an opening (not shown) is provided when or after knitting, allowing shoulder straps (not shown) to be connected to the inner cup 5 and closing means (not shown) to be affixed, which in turn allows exposing of the breast 9, which is then supported by the inner layer 5 of the breast cup 7 with an opening 100 for exposure of the nipple.

The shoulder straps (not shown) can be an integral part of the garment back portion, the second loop 4 or be sewn on to the garment at a later stage. When attached, the shoulder straps are extending from the garment back portion to the top end 8 of the inner cup layer 5.

Figure 2:
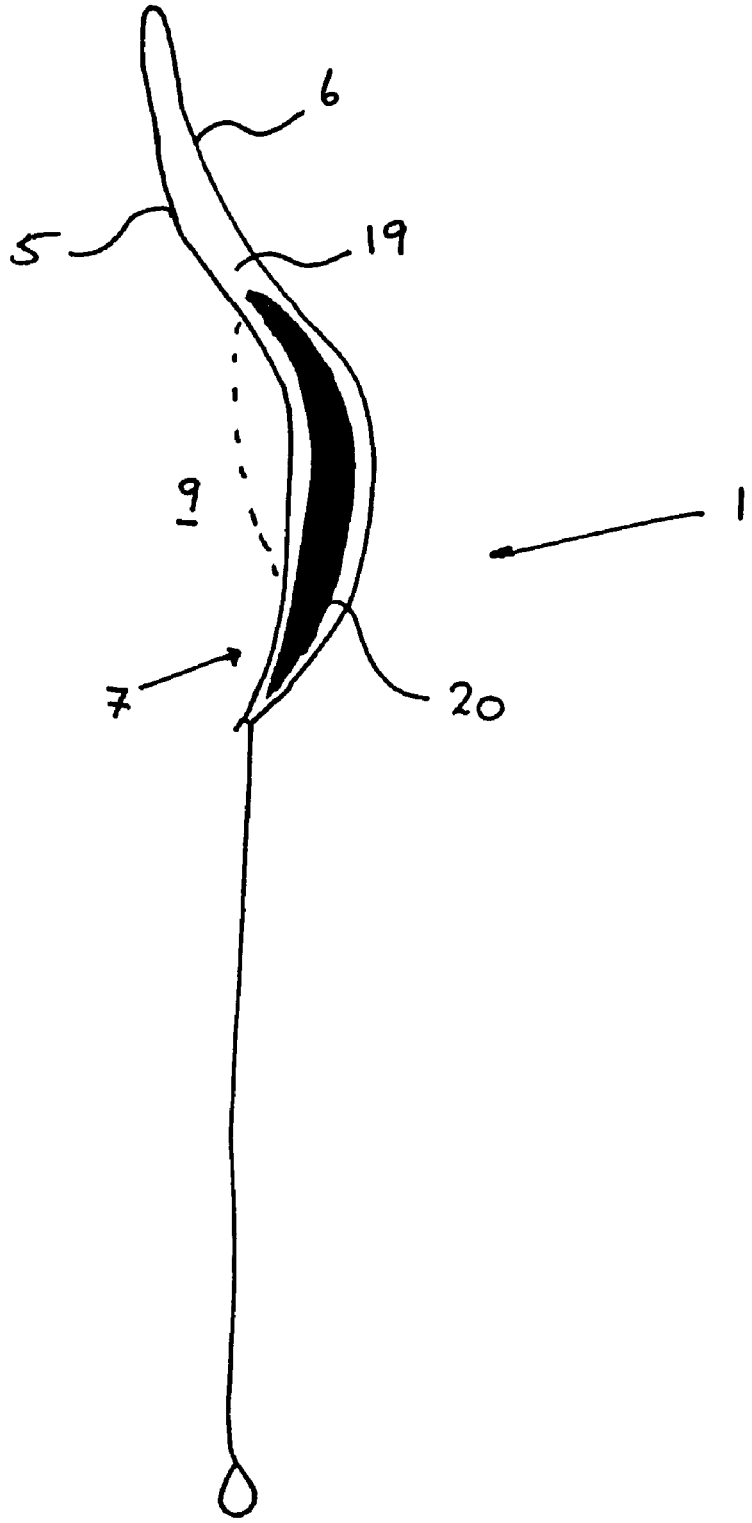

FIG. 2 shows a cross section of the front portion in the cup area of a circular knitted fabric tube 1, where the inner layer 5 and the outer layer 6 of the breast cups 7 are knitted together under the breast 9, and a space 19 between the inner layer 5 and the outer layer 6 of the breast cups 7 is provided, which space 19 can be applied for arranging a nursing pad, a breast prosthesis, a bandage, dressing or support material 20 in the breast cup area 7.

Figure 3:
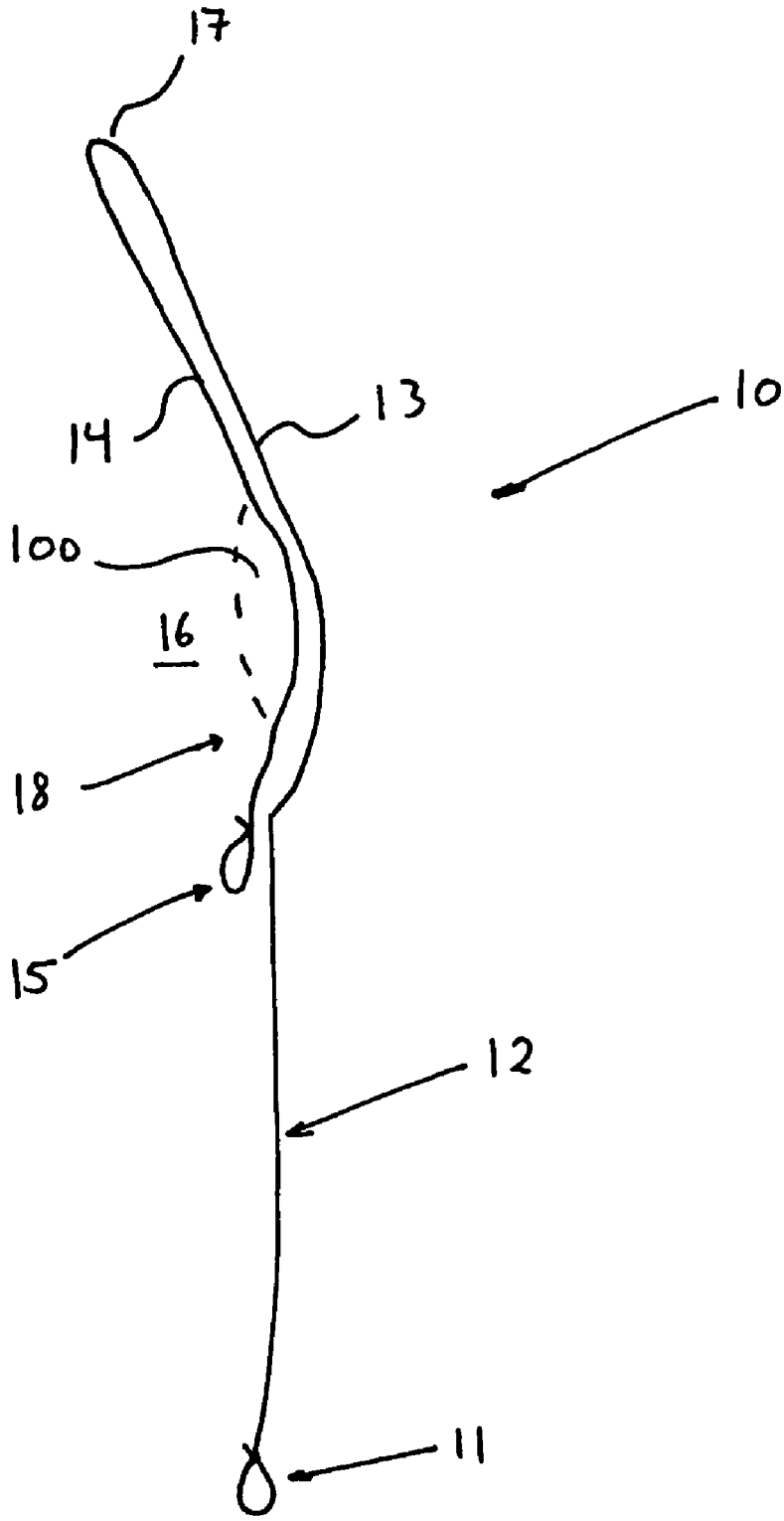

FIG. 3 shows a cross section of the front portion in the cup area of a circular knitted fabric tube 10, where a first loop 11 is knitted to provide a bottom band, which fits snugly or loosely around e.g. the hip or the waist of a woman. The first loop 11 is connected to the bottom part of the first portion 12, which is bent into an open loop-configuration, providing both an outer cup layer 13 and an inner cup layer 14, which ends in a third loop 15 to provide a band, which fits snugly under the breast 16 of the woman and prevents the breast 16 from dropping out of the breast cup 18.

Near the top end 17 of the open loop 13, 14 an opening (not shown) is provided when or after knitting, allowing shoulder straps (not shown) to be connected and opening means (not shown) to be affixed, which in turn allows pulling the outer cup layer 13 down exposing the inner cup layer 14, which in turn allows breast-feeding due to the opening 100 for exposure of the nipple.

According to this embodiment of the invention the inner breast cup 18 and the third loop 15 are hidden by the overlaying outer layer 13, hence making it possible to provide a garment with almost invisible brassiere support and nursing features, made from the circular knitted fabric tube 10.

The circular knitted fabric 10 with the first loop 11, the open loop or bend 12 and the second loop 15 is made as follows:

- to knit the circular knitted fabric 10 the first loop 11 is started by hanging up a first row of courses in a waiting position on the knitting machine,
- the length of the first loop 11 is knitted,
- the first loop 11 is closed by picking up the hung up courses, and knitting continues on the first portion 12, including the open loop comprising the outer layer 13 and the inner layer 14 of the first portion 12,
- the third loop 15 is started by hanging up a second row of courses in a waiting position on the knitting machine, then the length of the third loop 15 is knitted, and
- finally the loop 15 is closed by picking up the $2^{nd}$ row of hung up courses. After knitting, the open loop 13, 14 is formed from the first section 12 by bending the inner layer 14 into the circular knitted tube 10.

Figure 4:
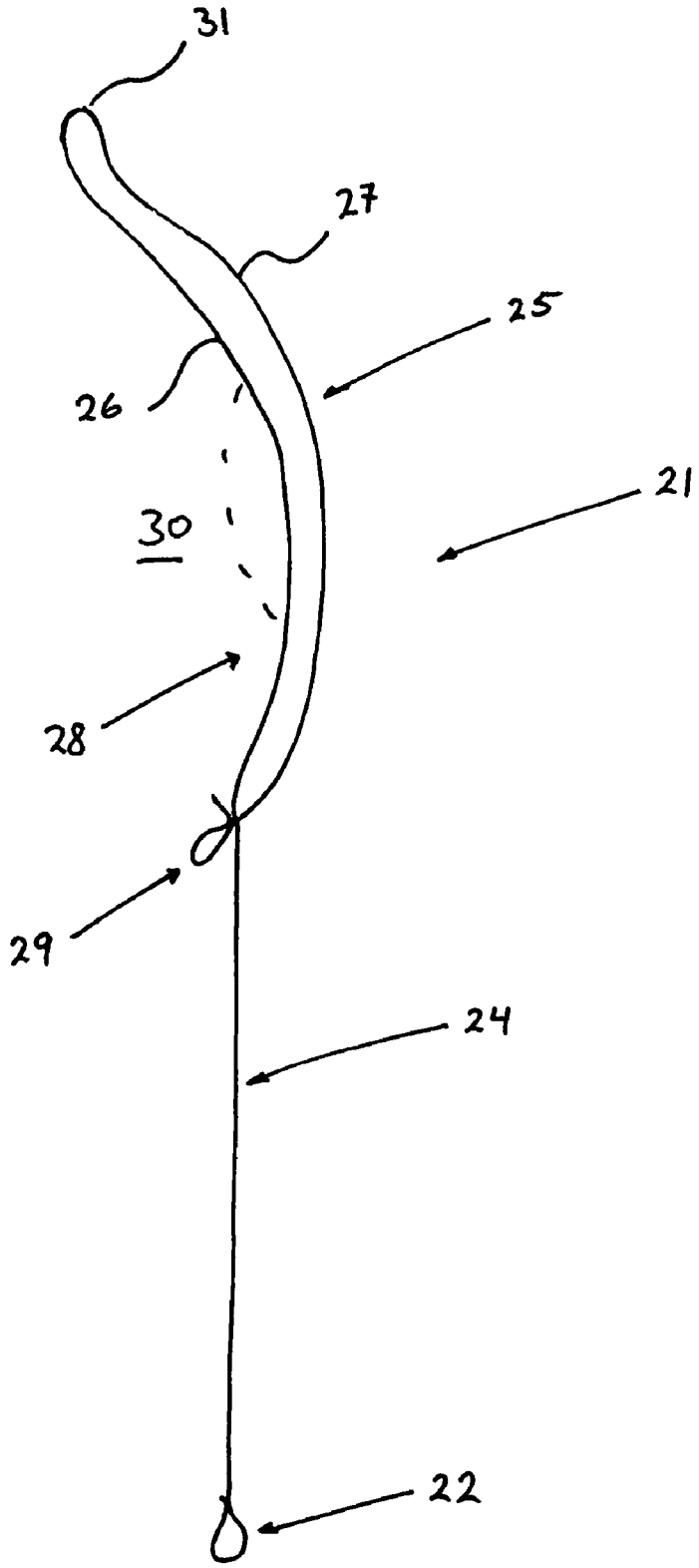

FIG. 4 shows a cross section of the front portion in the cup area of a circular knitted fabric tube 21, where a first loop 22 is knitted to provide a bottom band, which fits snugly or loosely around the hip or the waist of a woman. The first loop 22 is connected to the bottom part of a first portion 24, and the top part of the first portion 24 is connected to both ends of a second closed loop 25 to provide both the inner layer 26 and the outer layer 27 of the cups 28.

A third loop 29 is connected to the second loop 25 and provides a band, which fits snugly under the breasts 30, thus preventing the breasts 30 from dropping out of the breast cup 28.

The second loop 25 is opened in or after knitting near the top end 31 and provided with opening means (not shown), which makes it possible to release the outer layer 27 of the breast cups 28, hence exposing a breast 30, which is supported by the inner layer 26 of the breast cups 28.

The circular knitted fabric tube 21 with the first loop 22, the second loop 25 and the third loop 29 is made as follows:

- to knit the circular knitted fabric tube 21 a first row of courses is hung up in a waiting position at the knitting machine,
- the length of the first loop 22 is knitted,
- the first loop 22 is closed by picking up the hung up courses, and the knitting of the first portion 24 continues,
- at the end of the first portion 24, the second loop 25 is started by hanging up a second row of courses in a waiting position, while knitting the second loop 25,
- the second loop 25 is closed by picking up the second row of hung up courses, and a third loop 29 is started by hanging up a third row of courses in a waiting position, knitting the length of the third loop 29, and finally picking up and knitting the $3^{rd}$ row of courses to close the third loop 29.

The straps (not shown) can be an integral part of the back portion of the garment, the second loop 25 or be sewn on to the nursing garment later on.

Figure 5:
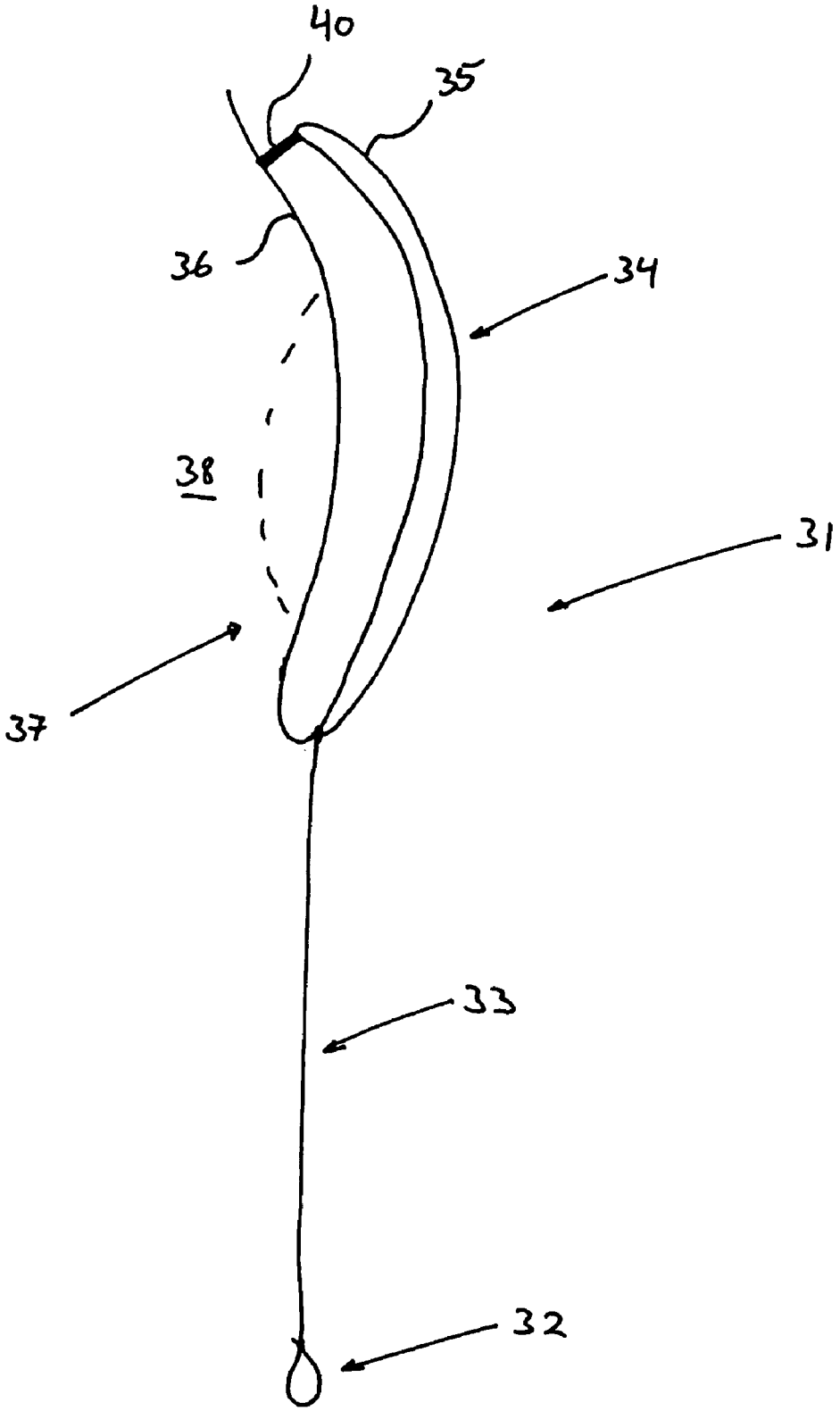

FIG. 5 shows a cross section of the front portion of a circular knitted fabric tube 31, where a first loop 32 is knitted to provide a bottom band, which fits snugly or loosely around the hips or the waist of a woman. The first loop 32 is connected to the bottom part of a first portion 33 and the top part of the first portion 33 is connected to both ends of a second loop 34 to provide a doubled layered outer layer 35. The doubled layered outer layer 35 is knitted together under the breast 38.

The second loop 34 is connected to a second portion 36 to form an open loop with the inner layer of the double layered outer layer 35 to provide the inner layer 36 of the breast cup 37, whereby the breast 38 is supported.

Opening means 40 are provided near the top end of the double outer layer 35 to connect the double outer layer 35 in a releaseable manner to the inner layer 36 to allow release of the outer layers 35, hence exposing a breast 38, which is supported by the inner layer 36 of the cups 37.

The circular knitted fabric tube 31 with the first loop 32, a first portion 33, the second loop 34 and the second loop portion 36 is made as follows:

- to knit the circular knitted fabric tube 31 a first row of courses is hung up in a waiting position on the knitting machine,
- the length of the first loop 32 is knitted,
- the first loop 32 is closed by picking up the hung up courses,
- knitting of the first portion 33 is continued,
- the second loop 34 is started at the end of the first portion 33 by hanging up a second row of courses in a waiting position,
- knitting of the second loop 34 continues,
- the loop 34 is closed by picking up the second row of hung up courses, whereby the doubled layered outer layer 35 is knitted together under the breast 38.
- knitting of the second portion 36 continues. When knitting is finished, the second portion 36 is folded upwards and inwards into the tube to form an open loop with the double layered outer layer 35.

The straps (not shown) can be an integral part of the garment back portion, the second portion 36 or be sewn on to the garment later on.

The double layered outer layer 35 according to this embodiment makes the garment front thicker, which is an advantage if the fabric quality or colour is transparent and as it adds support and warmth to the womans breasts.

Figure 6:
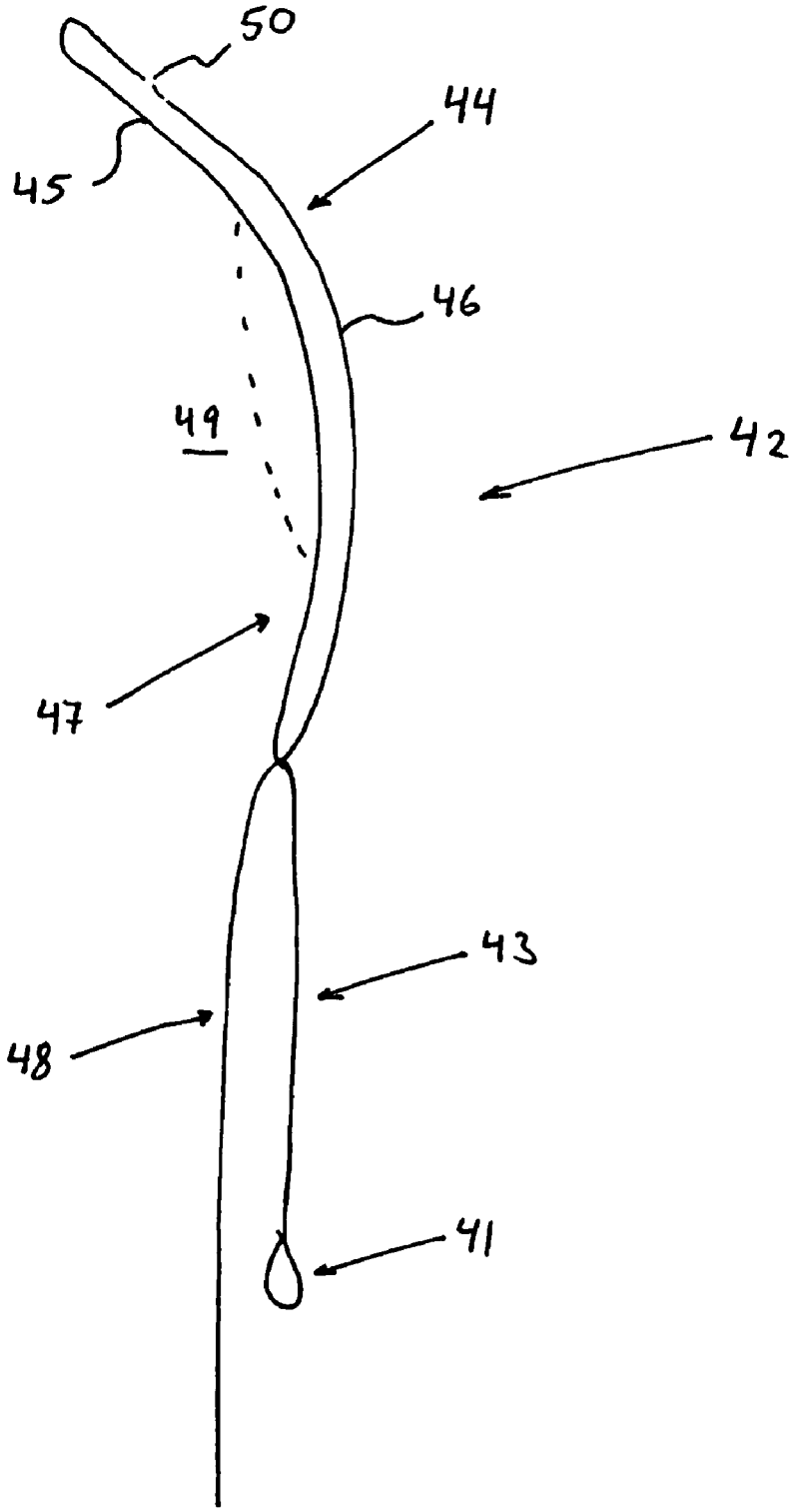

FIG. 6 shows a cross section of the front portion of a circular knitted fabric tube 42, where a first loop 41 is knitted to provide a bottom band, which fits snugly or loosely around e.g. the hips or the waist of a woman. The first loop 41 is connected to the bottom part of a first portion 43 and the top part of the first portion 43 is connected to both ends of a second loop 44 to provide both the outer layer 46 and the inner layer 45 of the cups 47, whereby the breast 49 is supported.

A second portion 48 of optional length is connected to the second loop 44, which second portion 48 can be used for providing a bottom part of the nursing garment e.g. a body stocking, trousers, panties, boxer shorts, a dress or the like.

The circular knitted fabric tube 42 with the first loop 41, the second loop 44 and the second portion 48 is made as follows:

- to knit the circular knitted fabric 42 a first row of courses is hung up in a waiting position on the knitting machine,
- the length of the first loop 41 is knitted, the first loop 41 is closed by picking up the hung up courses and knitting of the first portion 43 continues, the second loop 44 is started by hanging up a second row of courses in a waiting position on the knitting machine, the length of the second loop 44 is knitted, and the second loop 44 is closed by picking up the hung up courses, and knitting is continued in the second portion 48.

An opening 50 is provided to release the outer layer 46, hence exposing a breast 49, which is supported by the inner layer 45 of the cups 47.

Figure 7:
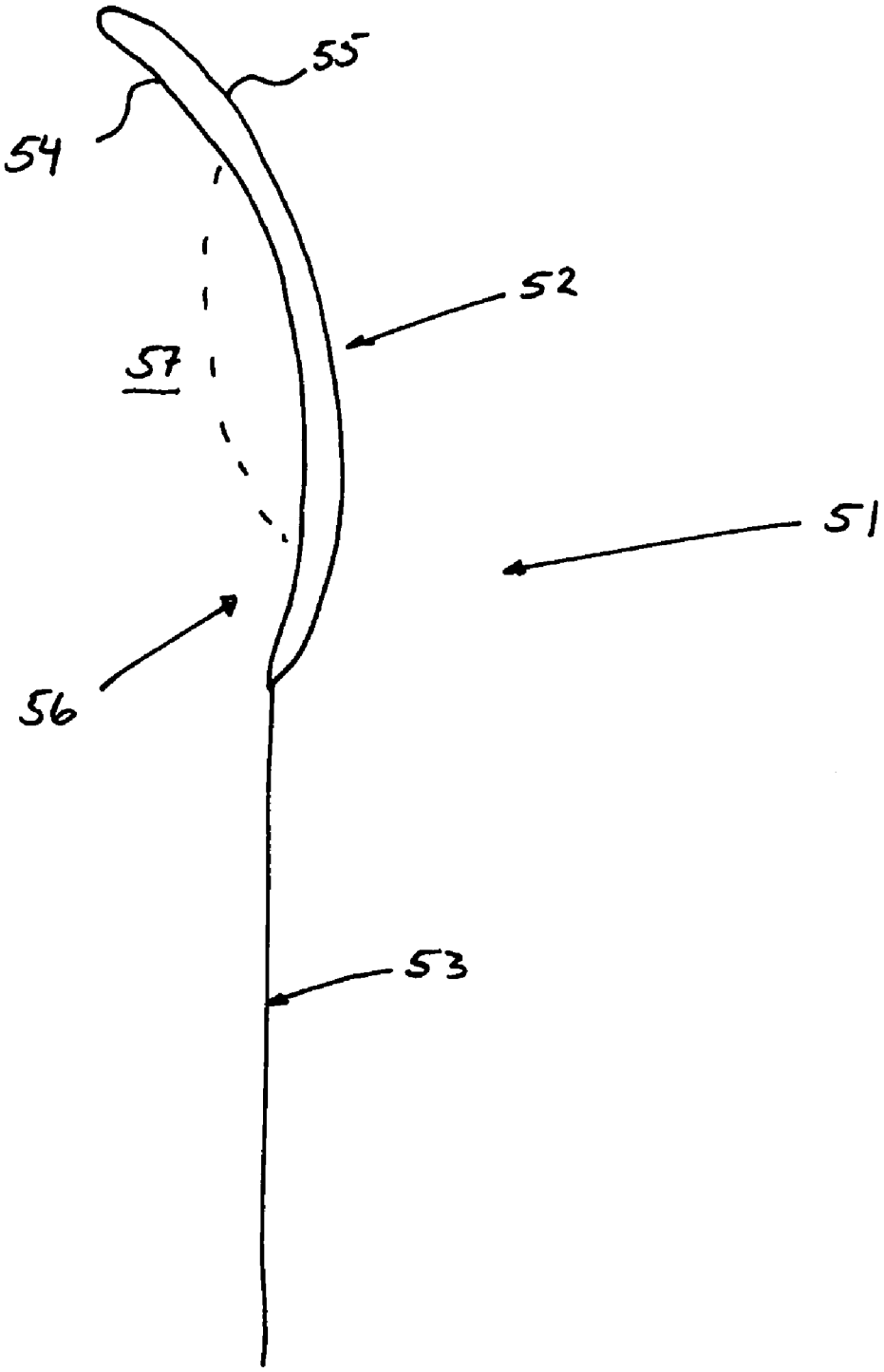

FIG. 7 shows a cross section of the front portion in the cup area of a circular knitted fabric tube 51, where a first loop 52 is knitted and connected at both ends to a first portion 53. The first loop 52 provides both the inner layer 54 and the outer layer 55 of the cups 56, whereby the breast 57 is supported.

The first portion 53 can optimally be used to provide the bottom part of e.g. a dress, a shirt, an undershirt, a body stocking, panty hose, panties, a ribbed band, roll edge, band or the like.

Figure 8:
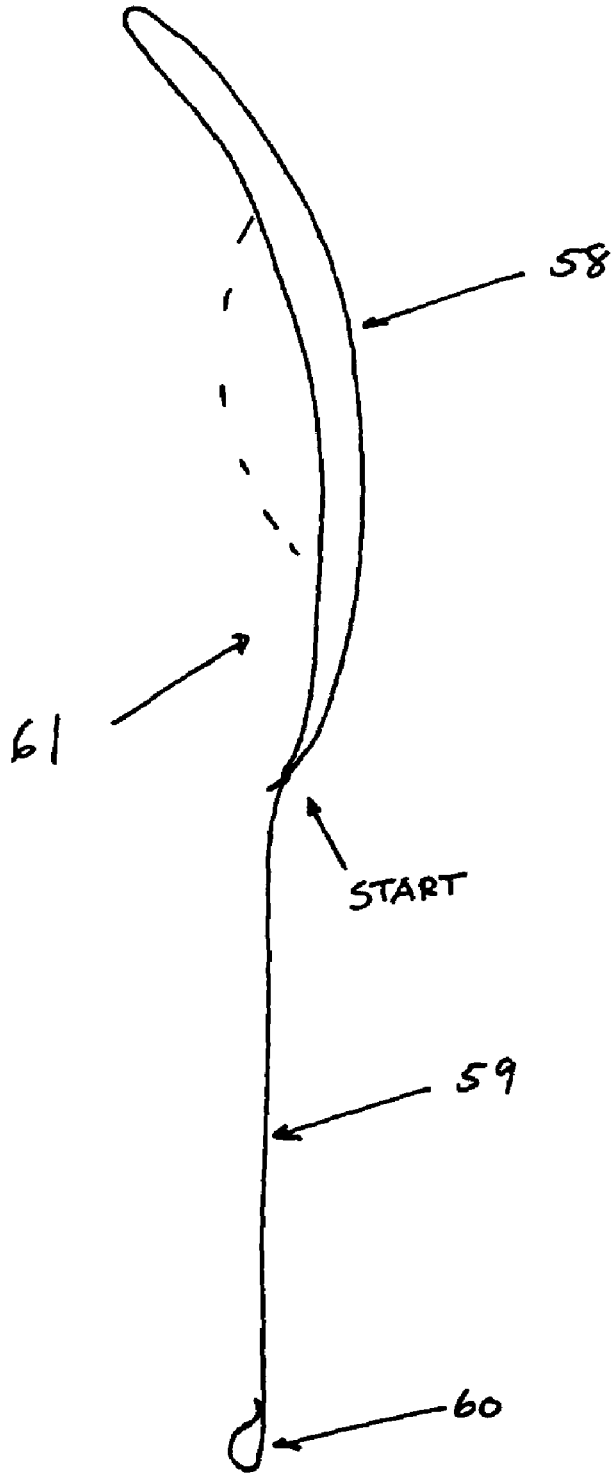

FIG. 8 shows schematically that any of the embodiments of the aforementioned circular knitted fabric tube can be knitted reversely, starting from the opposite end. Hence it is possible to start as shown by knitting the first loop 58 to provide the cups 61, pick up the hung up courses and then knit the first portion 59 to provide the body of the garment and finally knit the second loop 60, which provides a bottom band.

Figure 9:
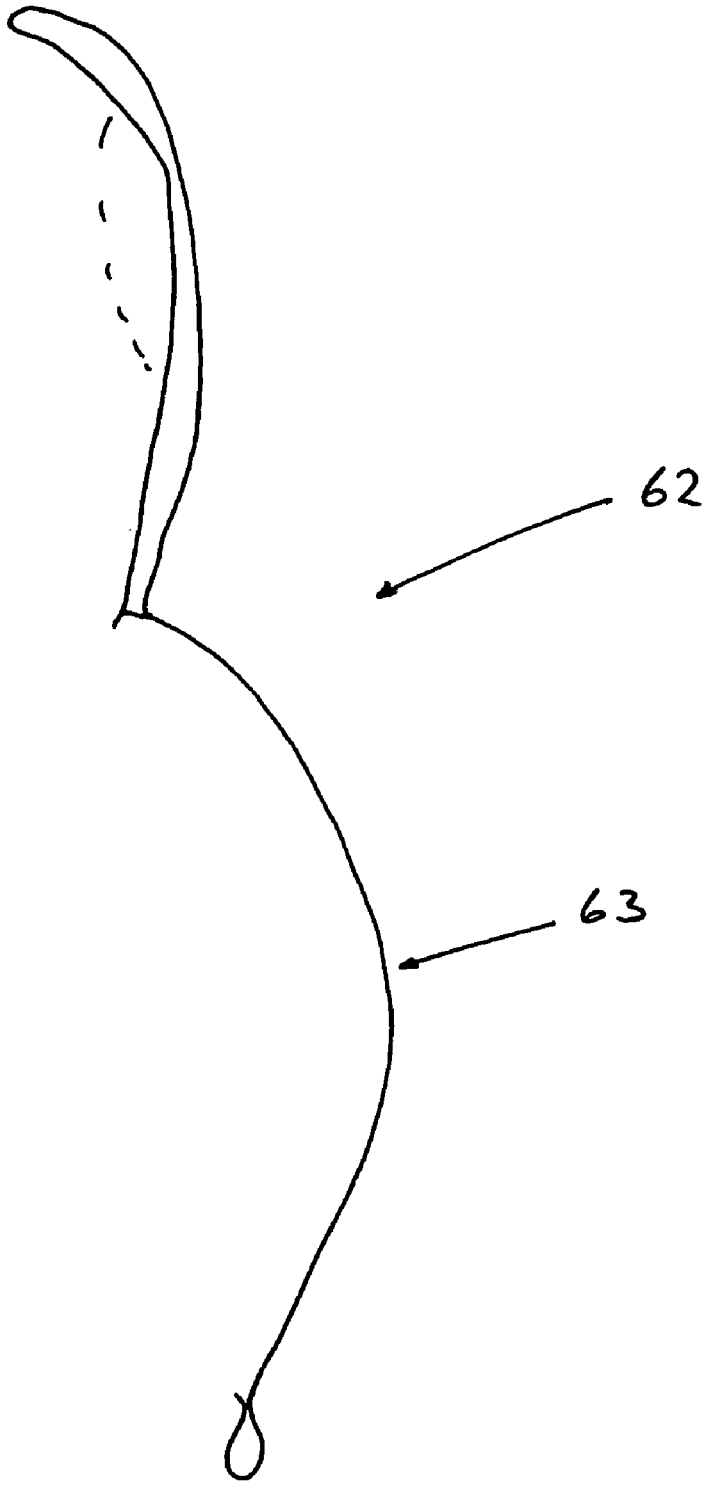

FIG. 9 shows a cross section of the front portion of a circular knitted fabric 62, where the first portion 63 is provided with shape and support areas for the stomach of a pregnant woman or flattening and support areas for the stomach of a woman, who has just given birth. To support the stomach the first portion 63 is e.g. made of high strength and/or elastic yarns.

Figure 10A:
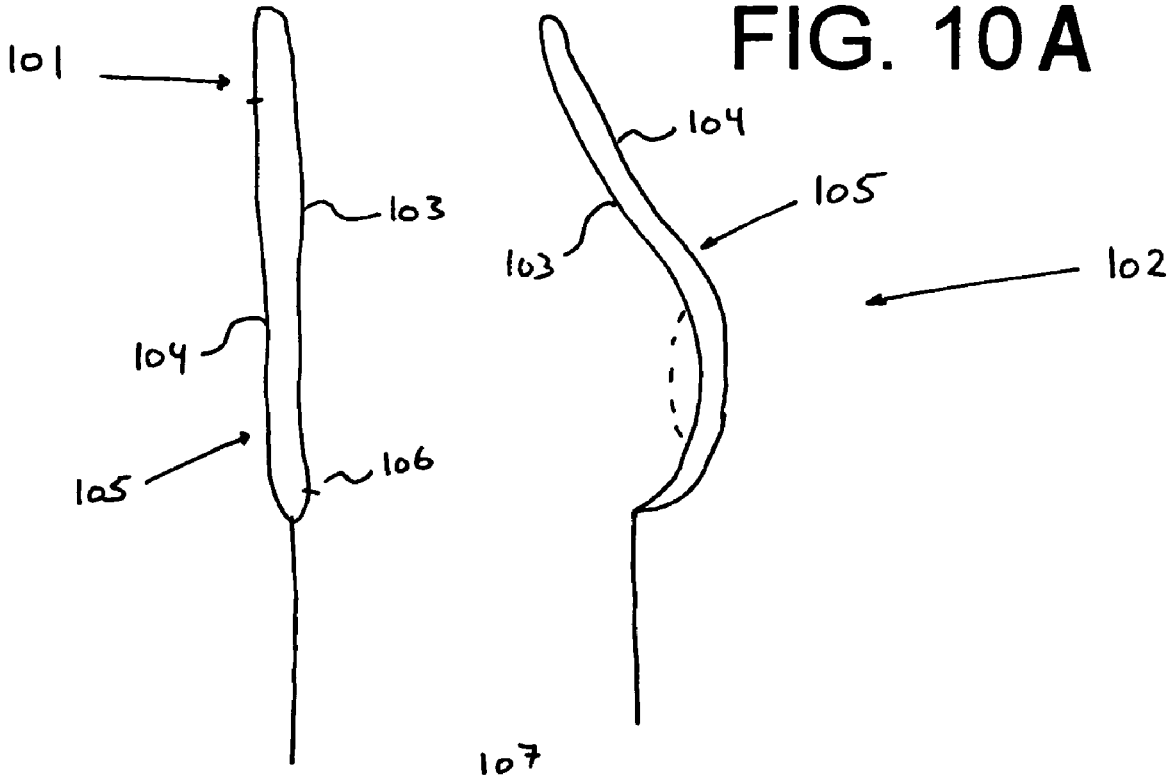
Figure 10B:
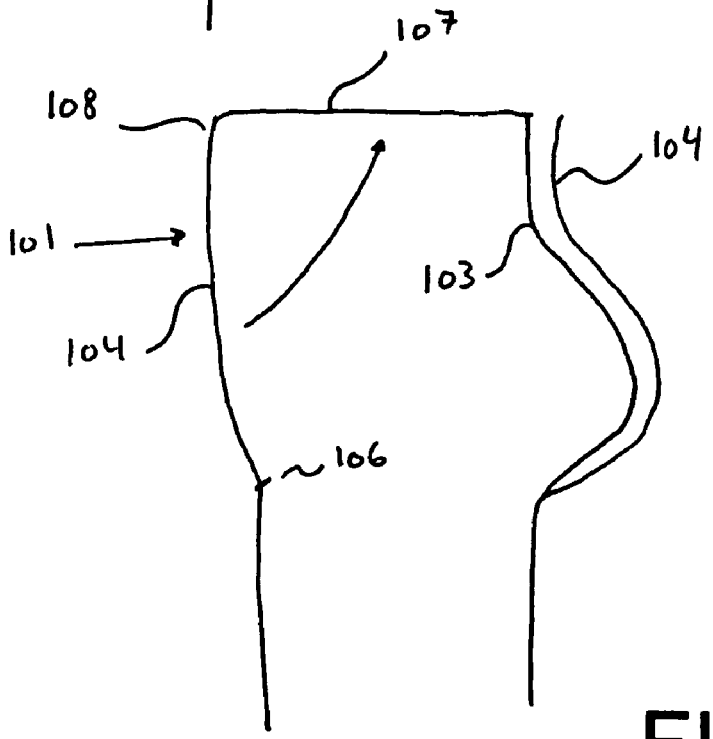

FIG. 10*a* and FIG. 10*b* shows the cross sections of the top part of a back portion and the front portion of a garment according to the present invention.

FIG. 10*a* shows how the back portion 101 of the circular knitted tube 102 may look with an inner layer 103 and an outer layer 104, when the breast area is knitted as a closed loop 105.

FIG. 10*b* illustrates how the back portion 101 inner layer 103 from FIG. 10*a* may be released (i.e. cut open) at its lower end 106, in order to form integrated shoulder straps 107 extending from the back portion 101 and connecting to the breast cup inner layer 103 and in a releaseable manner, e.g. by clasps (not shown) to the outer breast cup layer 104.

Alternatively, some of the back portion outer layer 104 and the back portion inner layer 103 may be removed, and separate shoulder straps 107 may be sewn on to the back portion 101 outer layer 104 top end 108 and to the cup inner layer 103, and in a releasable manner to the outer breast cup layer 104.

Figure 11:
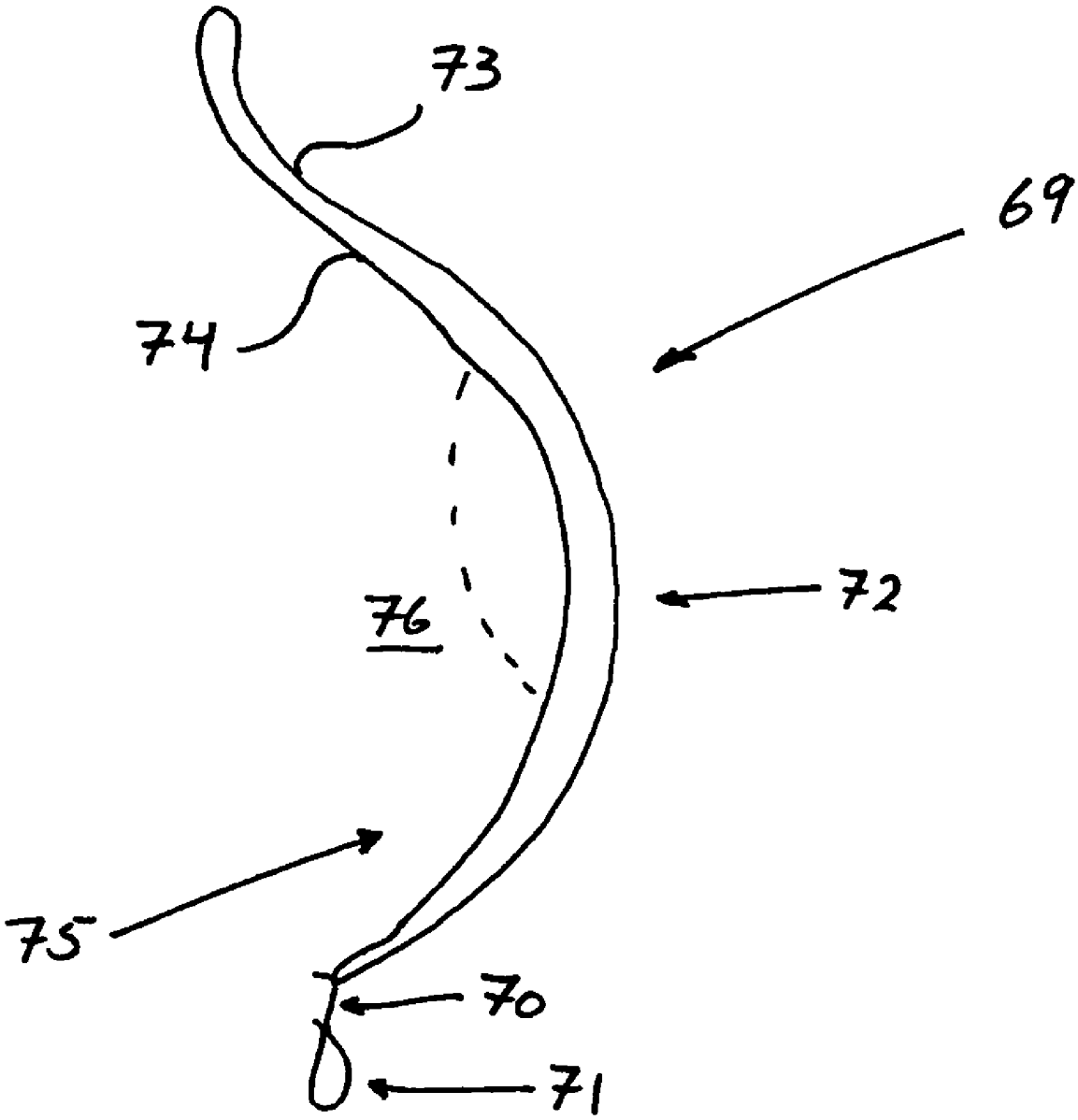

FIG. 11 shows a cross section of the front portion in the cup area of a circular knitted fabric tube 69, which provides a nursing garment in the shape of a brassiere, where a shorter first portion 70 is connected at the lower end to both ends of a first loop 71 to provide a band to fit under the breast and at the top end to both ends of a second loop 72, which provides the outer layer 73 and the inner layer 74 of the breast cup 75, whereby the breast 76 is supported.

Figure 12:
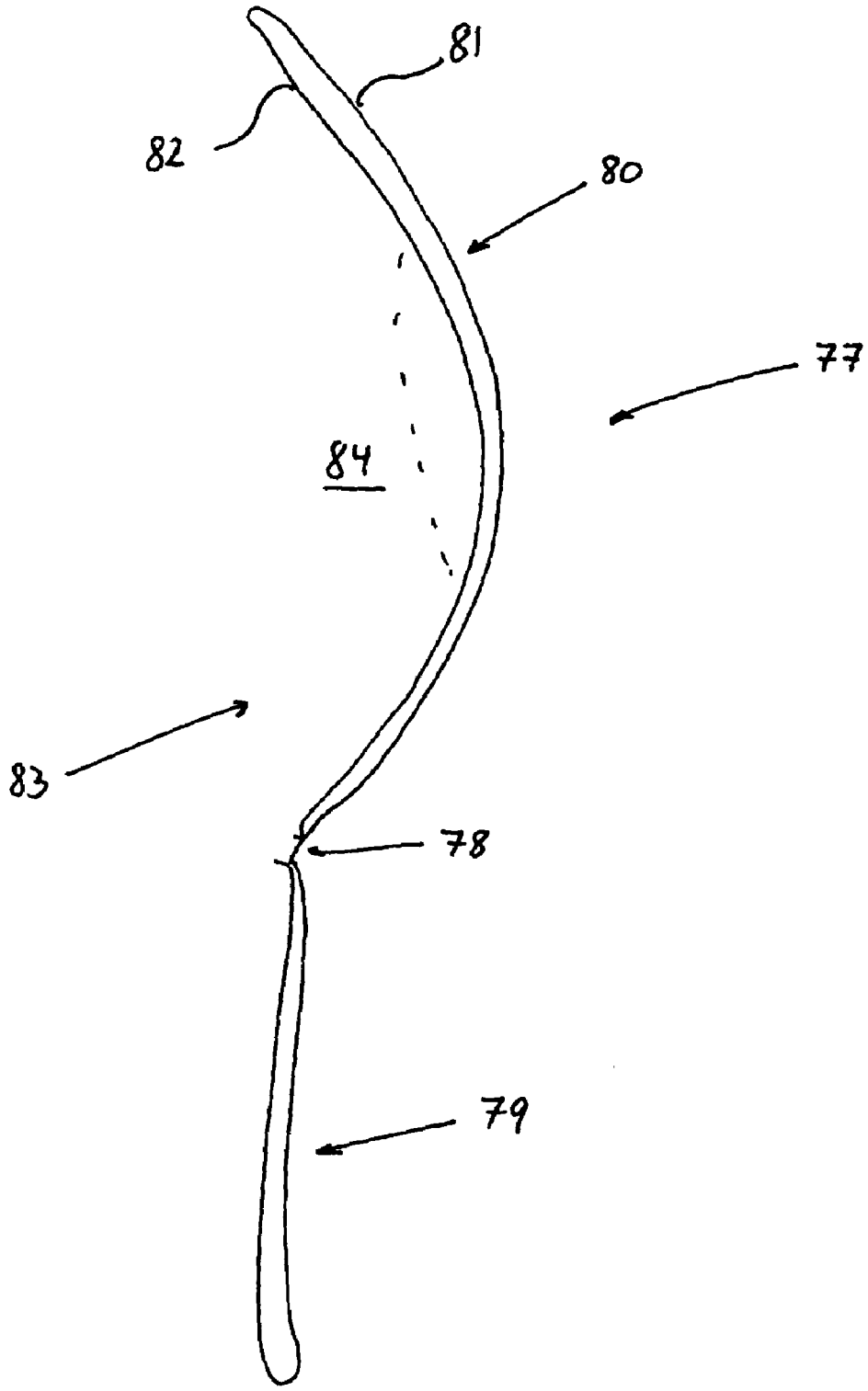

FIG. 12 shows a cross section in the cup area of the front portion of a circular knitted fabric tube 77, where a short first portion 78 at the lower end is connected to both ends of a first closed loop 79, which provides a double layered body-encircling lower part of the garment, and at the top end it is connected to a second closed loop 80, which provides the outer layer 81 and the inner layer 82 of the breast cup 83, whereby the breast 84 is supported.

The double layered part of the garment body can be used to reduce transparency, to provide extra support to the stomach and/or the back or for adding warmth.

Figure 13:
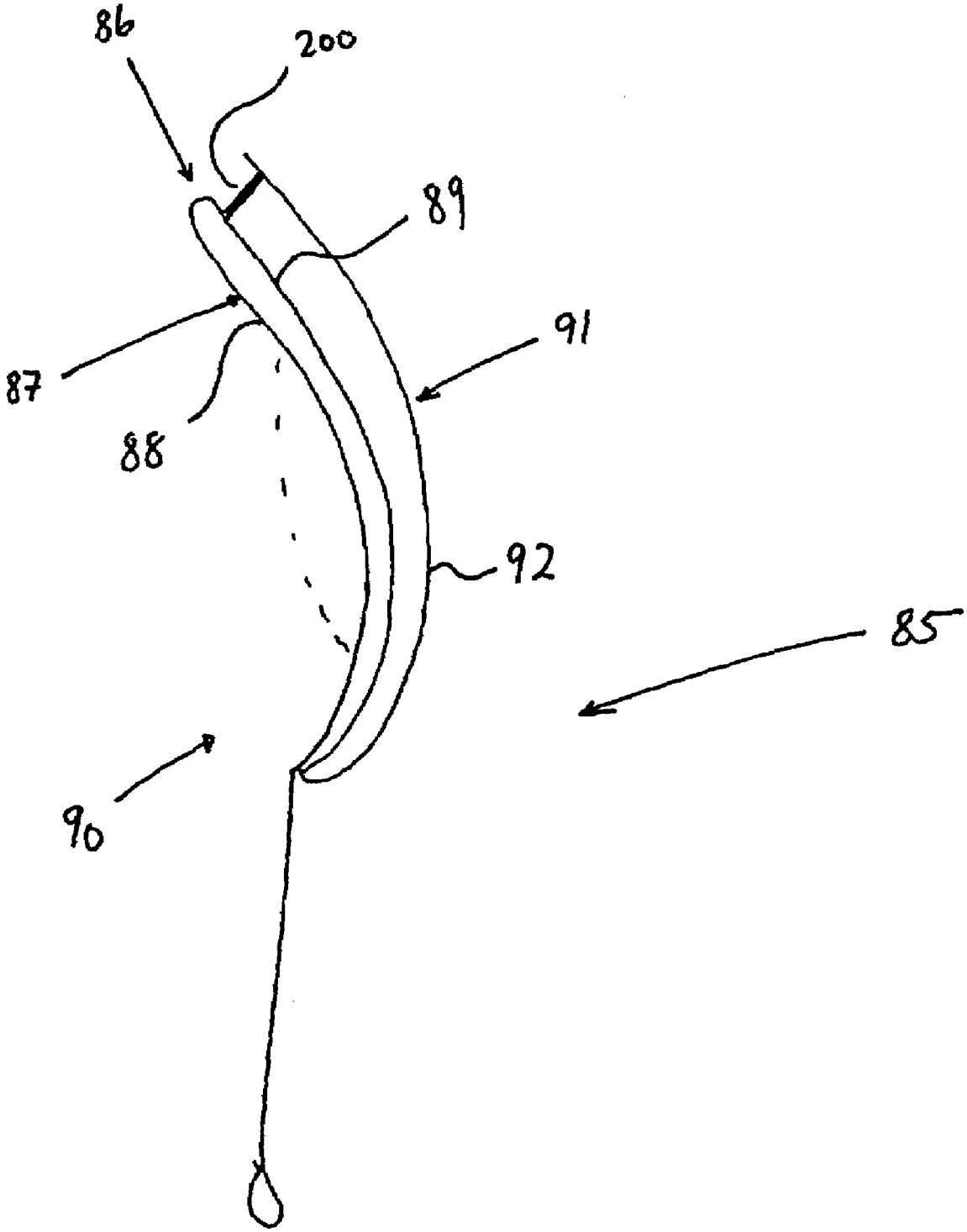

FIG. 13 shows a cross section in the cup area of the front portion of a circular knitted fabric tube 85, which in principle is similar to the circular knitted fabric 31 shown in FIG. 5, with the difference that the second loop 86 provides a doubled layered inner layer 87, which comprises the inner layers 88, 89 of the breast cups 90, and that the second portion 91 forms an open loop with the inner layer 89, and provides the outer layer 92 of the nursing garment, when it is folded upwards and outwards on the tube 85. An opening device 200 is provided near the top end of the outer layer 92, to allow the outer cup layer 92 to be released from the inner breast cup 86. In this case, the double layered inner cup 86 offers more support and warmth and less transparency when nursing, due to the extra fabric layer.

Figure 14:
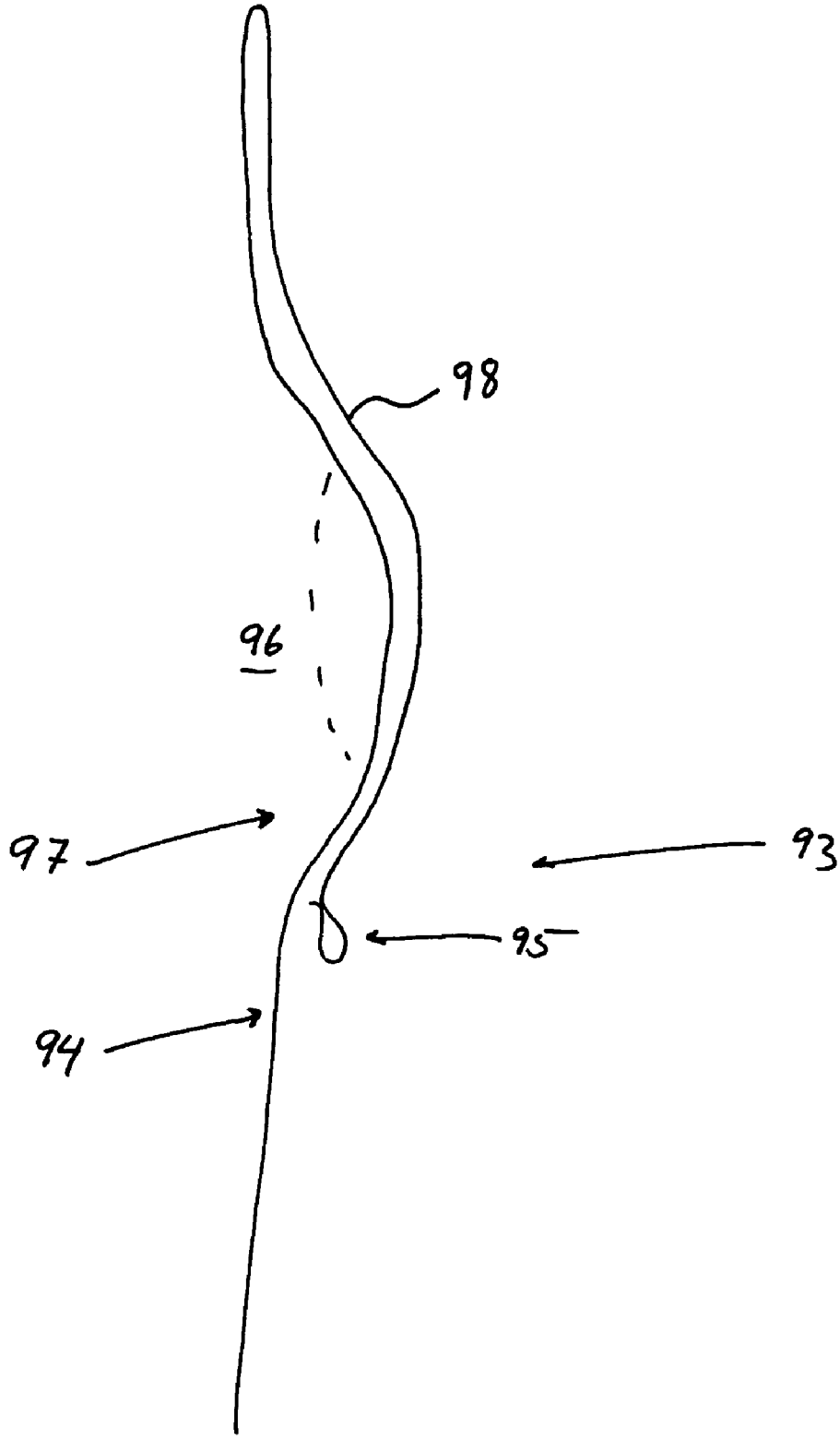

FIG. 14 shows a cross section of the front portion of a circular knitted fabric tube 93 which in principle is similar to the circular knitted fabric 10 shown in FIG. 3, but the difference is that the inner layer 94 is continued downwards in an optional length and that the first loop 95 is connected to the open loop double layer 98 and provides a band under the breast 96 to prevent the breast 96 from dropping out of the cup 97, which is formed by the inner layer 94. For nursing, the outer layer 98 is lifted over the breast 96 to expose the breast. This embodiment reduces or eliminates the need for clasps and/or straps and still allows the woman to breast-feed without exposing her body.

The invention is not limited to the applications shown in the drawings and the embodiments described above. Other embodiments comprising other forms of the nursing garments types, inner and outer cups, the shoulder straps, and closing means as well as back portion types are possible within the scope of the present invention and as described in the claims.

The invention claimed is:

1. Method for providing a nursing garment from a circular knitted fabric tube, wherein the nursing garment comprises a back portion and a front portion comprising breast cups completely or partly formed from at least a double layer of fabric, forming inner- and outer breast cups, wherein said double layer of fabric is knitted integrally in one piece and positioned in the nursing garment and used in an open or closed knitted fabric loop form, and wherein at least one of the fabric layers has a knitted end below the breast, which loop form provides an option open to continue knitting downwards from below the breast.

2. Method according to claim 1, wherein the double fabric loop forming the breast cups is closed below the breasts, so that the inner layer connects to the outer layer of the garment below the breasts.

3. Method for providing a nursing garment from a circular knitted fabric tube, wherein the nursing garment comprises a back portion and a front portion comprising breast cups completely or partly formed from at least a double layer of fabric, forming inner and outer breast cups, wherein the double fabric loop comprising the breast cups is formed by hanging up at least partly a row of courses in a waiting position on the knitting machine, then knitting the cups and picking up the hung up courses afterwards to form an at least partly closed loop in the breast area directly in the knitting process.

4. Method for providing a nursing garment from a circular knitted fabric tube, wherein the nursing garment comprises a back portion and a front portion comprising breast cups completely or partly formed from at least a double layer of fabric, forming inner- and outer breast cups, wherein the double fabric loop is formed after knitting by bending at least part of the tube outwards or inwards to itself, leaving the inner and outer layers disconnected at the lower end, with the object of providing a nursing garment where the outer and inner cups are not knitted together below the breasts.

5. Method according to claim 1, wherein at least one body encircling tube portion is extending downwards from below the breasts.

6. Method according to claim 5, wherein the tube portion extending downwards from below the breast comprises means such as shape, structures or yarn combinations for supporting a pregnant or post-natal belly.

7. Method according to claim 1, wherein at least one additional tubular portion is knitted to the circular knitted fabric tube, adding e.g. a third fabric layer in the cup area.

8. Method according to claim 1, wherein at least one closed loop for providing a double layer body encircling portion or band is knitted to the circular knitted fabric tube.

9. Method according to claim 1, wherein a pair of shoulder straps is connected to the front portion, and the shoulder straps may be sewn in or be integrally knitted and may be adjustable in length.

10. Method according to claim 1, wherein a vertical opening is provided in the tubular garment and provided with closing fasteners, for formation of a garment that can be opened, put on and closed afterwards.

11. Method according to claim 1, wherein releasable closing and opening means, such as clasps, are provided at the high end of the outer cups, connecting in an easily releasable manner to the shoulder straps and/or inner cups, allowing the outer cup to be released and the inner cup to be exposed.

12. Garment, for use when nursing, produced according to the method according to claim 1, wherein the nursing garment comprises a portion extending below the breasts, formed into a garment.

13. Garment produced according to the method according to claim 1, wherein the garment is intended to hold a device, such as a nursing pad, a dressing, a bandage or a breast prosthesis in place between layers of fabric or between the body and the garment.

14. Garment according to claim 12, wherein openings are provided in the double layer fabric loop above the breast cups by the use of opening means, enabling shoulder straps and releasable closure devices to be attached, thereby allowing the outer cup to be released, in order to expose the inner cup.

15. Garment according to claim 12, wherein the inner cups are provided in a size and shape, allowing the nipple to be exposed for breast-feeding when the outer cup is released.

16. Method according to claim 4, wherein a vertical opening is provided in the tubular garment and provided with closing means, such as zippers, hook/loop, hook/eye, for formation of a garment that can be opened, put on and closed afterwards.

17. Garment, for use when nursing, produced according to the method according to claim 4, wherein the nursing garment comprises a portion extending below the breasts, formed into a garment, such as a camisole, a chemise, a tank top, a vest, a dress, a body stocking or the like.

* * * * *